US005791793A

United States Patent [19]

Nagahata

[11] Patent Number: 5,791,793

[45] Date of Patent: Aug. 11, 1998

[54] THERMAL PRINTHEAD AND PROTECTION COVER MOUNTED ON THE SAME

[75] Inventor: Takaya Nagahata, Kyoto, Japan

[73] Assignee: Rohm Co., Ltd., Kyoto, Japan

[21] Appl. No.: 860,971

[22] PCT Filed: Nov. 28, 1996

[86] PCT No.: PCT/JP96/03499

§ 371 Date: Jul. 3, 1997

§ 102(e) Date: Jul. 3, 1997

[87] PCT Pub. No.: WO97/19817

PCT Pub. Date: Jun. 5, 1997

[30] Foreign Application Priority Data

Nov. 30, 1995 [JP] Japan ..... 7-312099
Dec. 6, 1995 [JP] Japan ..... 7-317730

[51] Int. Cl.[6] ..... B41J 2/315

[52] U.S. Cl. ..... 400/120.01; 400/120.18; 347/200; 347/201

[58] Field of Search ..... 400/120.01, 120.18; 346/139 C; 347/200, 201

[56] References Cited

U.S. PATENT DOCUMENTS 4,963,886 10/1990 Fukuda et al. ..... 346/76 AP
4,972,205 11/1990 Nagato ..... 346/139 C
5,568,174 10/1996 Nagahata et al. ..... 347/200
5,568,176 10/1996 Moon et al. ..... 347/200
5,570,123 10/1996 Almonte ..... 347/200

FOREIGN PATENT DOCUMENTS 0 544 607 6/1993 European Pat. Off. .
61-132356 6/1986 Japan .
61-181656 8/1988 Japan .
4-50237 4/1992 Japan .
5-162348 6/1993 Japan .
6-17938 3/1994 Japan .

*Primary Examiner*—Edgar S. Burr
*Assistant Examiner*—Anthony H. Nguyen
*Attorney, Agent, or Firm*—Merchant, Gould, Smith, Edell, Welter & Schmidt

[57] ABSTRACT

A thermal printhead (10) includes an insulating head substrate (11) having a first edge (11*a*) and a second edge (11*b*) opposite to the first edge, a heating resistor (12) formed on the head substrate (11) along the first edge (11*a*), at least one drive IC (13) mounted on the head substrate (11) along the second edge (11*b*), and a protection cover (20) mounted for covering the drive IC (13). The protection cover (20) includes a cover member (22) for covering the drive IC (13) and a fixation member (21) formed integrally with the cover member (22). The fixation member (21) has a positioning wall (23) coming into direct contact with the second edge (11*b*) of the head substrate (11). The fixation member is designed to attach the protection cover (20) to the head substrate (11) without utilizing separate fixing means.

13 Claims, 6 Drawing Sheets

THERMAL PRINTHEAD AND PROTECTION COVER MOUNTED ON THE SAME

TECHNICAL FIELD

The present invention relates to a thermal printhead and a protection cover mounted on the same.

BACKGROUND ART

A typical thermal printhead includes an insulating head substrate formed with a heating resistor and drive ICs for actuating the heating resistor. The head substrate is mounted on a supporting member which is made of aluminum for example and has good thermal conductivity.

Taking a thick film-type thermal printhead for example, a narrow strip-like heating resistor is formed on a substrate by a thick film printing method. The narrow strip-like heating resistor is longitudinally sectionalized into tiny regions to provide heating dots. These heating dots are electrically connected, via a plurality of individual electrodes, to output pads of drive ICs. Further, the heating dots are equally connected to a common electrode. Each output pad of a drive IC is connected to an individual electrode by a bonding wire.

The drive ICs and the bonding wires are enclosed by a hard protection coating made of a thermosetting resin such as an epoxy resin for example. Main functions of the protection coating are to protect the drive ICs and wire-bonded portions from external mechanical forces and to prevent static electricity from destroying the drive ICs. The reason such a preventive measure is necessary to be taken for the drive ICs is that the static electricity, which is generated on the recording paper due to the sliding contact between the recording paper and the heating resistor during printing operation, may be discharged to the drive ICs and destroy them.

In the field of thermal printheads, high-speed printing has been increasingly required. To meet this requirement means to increase the speed of sliding movement of the recording paper relative to the heating resistor. As a result, a greater amount of static electricity will be generated on the recording paper during the printing operation, and the discharge may eventually become unbearable to the protection coating.

To cope with such a problem, conventionally, a protection cover may be additionally provided for covering a protection coating which encloses drive ICs and bonding wires. Such a protection cover prevents the electrostatically charged recording paper from coming into direct contact with the protection coating.

Many conventional protection covers are mounted on thermal printheads by using fixing means such as screws (see U.S. Pat. No. 4,963,886). With such an arrangement, a protection cover is usually attached to a supporting member of the thermal printhead or to a printed circuit board for external connection. To fix the protection cover by fixing means such as screws is a troublesome operation, and it is difficult to locate the protection cover with satisfactory accuracy. Further, the error in attaching the supporting member to the head substrate is additional to the error in attaching the printed circuit board for external connection to the head substrate. Therefore, the positioning accuracy of the protection cover relative to the heating resistor of the head substrate cannot be improved beyond a certain level.

DISCLOSURE OF THE INVENTION

Therefore, it is an object of the present invention to provide a protection cover for a thermal printhead, which is attached to a head substrate with ease and high positional accuracy.

It is another object of the present invention to provide a thermal printhead carrying such a protection cover.

According to a first aspect of the present invention, there is provided a thermal printhead including an insulating head substrate having a first edge and a second edge opposite to the first edge, a heating resistor formed on the head substrate along the first edge, at least one drive IC mounted on the head substrate along the second edge, and a protection cover mounted for covering the drive IC. The protection cover includes a cover member for covering the drive IC and a fixation member formed integrally with the cover member. The fixation member has a positioning wall coming into direct contact with the second edge of the head substrate. The fixation member is designed to attach the protection cover to the head substrate without utilizing separate fixing means.

According to a preferred embodiment of the present invention, the fixation member of the protection cover is made in a form of a channel groove having a pair of elastically deformable clip pieces projecting from the positioning wall toward the head substrate. A minimum distance between the clip pieces in an original state is set to be smaller than a thickness of the head substrate so that the second edge of the head substrate is clipped by the clip pieces. Thus, the assembling operation of the protection cover can be performed with remarkable ease, and adaptation to automatic assembling is easily realized, as opposed to an attaching manner which requires separate fixing means such as screws or tools.

The protection cover of the above embodiment is attached to the head substrate, unlike the prior art wherein a supporting member or printed circuit board for external connection is utilized for attachment. Thus, it is possible to attain a high positioning accuracy of the cover member, in particular, relative to the heating resistor on the head substrate. The transferring path for recording paper in the printing unit utilizing a thermal printhead is mainly determined by a platen arranged in facing relation to the heating resistor on the head substrate. Ideally, the position of the platen should be determined based on that of the heating resistor on the head substrate in particular. In the above embodiment, as already described, the position of the cover member of the protection cover is determined relative to the head substrate. Thus, in the above embodiment, it is easy to perform an ideal and accurate positioning of the cover member relative to the transferring path of the recording paper. As a result, while it is possible to minimize the uneven contacting of the recording paper with the protection cover, the projection length of the cover member can be maximized so that the protection cover properly and fully serves to protect the drive ICs and guide the recording paper.

In the preferred embodiment described above, one of the clip pieces has a flat contact surface held in surface contact with an obverse surface of the head substrate, while the other clip piece has a convexly curved portion held in contact with a reverse surface of the head substrate. Such features are advantageous in making the attachment reliable and stable.

Further, in the above preferred embodiment, advantageously, the head substrate is mounted on an electrically conductive supporting member having a high thermal conductivity, the protection cover is electrostatically conductive, and a portion of the fixation member of the protection cover contacts the supporting member. With such an arrangement, the printing performance of the thermal printhead is improved due to a proper heat-dissipating function of the supporting member. Further, the static electricity generated on the recording paper during high-speed printing operation for example can be lead to the conductive supporting member via the protection cover. As a result, the drive ICs on the head substrate are advantageously prevented from breaking down due to the discharge of the static electricity.

The protection cover may be integrally formed by a carbon-containing synthetic resin to provide an electrostatic conductivity.

According to another preferred embodiment of the present invention, the head substrate is mounted on an electrically conductive supporting member having a high thermal conductivity, and the fixation member of the protection cover is made in a form of a frame which includes an engaging front wall coming into engagement with an edge of the supporting member adjacent to the heating resistor, and a pair of side walls connecting the engaging front wall to the positioning wall. In this embodiment again, the cover member of the protection cover is accurately positioned relative to the head substrate by the positioning wall.

Since there is no need to use separate fixing means such as screws, the attachment of the protection cover is easily performed.

In the above-mentioned second preferred embodiment, the positioning wall preferably includes a step portion engaging the obverse surface of the head substrate adjacent the second edge of the head substrate. As already described, the inconvenience caused by the accumulation of static electricity is eliminated, if the protection cover is integrally formed by an electrostatically conductive material such as a carbon-containing synthetic resin.

According to still another preferred embodiment of the present invention, the drive ICs on the head substrate are enclosed by a hard protection coating, while the cover member of the protection cover, which is elastically deformable, comes into elastic contact with the protection coating. With such an arrangement, the cover member of the protection cover is always held in elastically close contact with the hard protection coating enclosing the drive ICs. Therefore, it is possible to advantageously prevent a transfer error of the recording paper, which otherwise might be caused by the recording paper entering a clearance between the cover member and the protection coating.

According to a second aspect of the present invention, there is provided a protection cover mounted on a thermal printhead including an insulating substrate having a first edge and a second edge opposite to the first edge, a heating resistor formed on the head substrate along the first edge, and at least one drive IC disposed on the head substrate along the second edge. The protection cover including a cover member for covering the drive IC, and a fixation member formed integrally with the cover member.

The fixation member has a positioning wall coming into direct contact with the second edge of the head substrate. The fixation member is attached to the head substrate without utilizing separate fixing means.

Other objects, features and advantages of the present invention will be clearer from the detailed explanation of the embodiments described below with reference to the accompanying drawings.

BEST MODE FOR CARRYING OUT THE INVENTION

Figure 1:
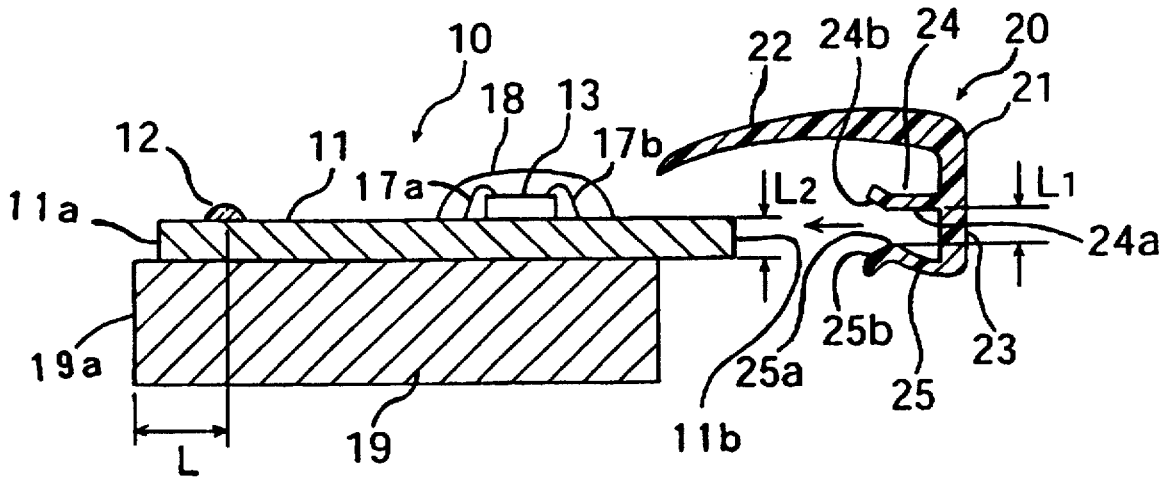
FIG. 1 is a cross-sectional view showing a thermal printhead according to a first embodiment of the present invention.
Figure 2:
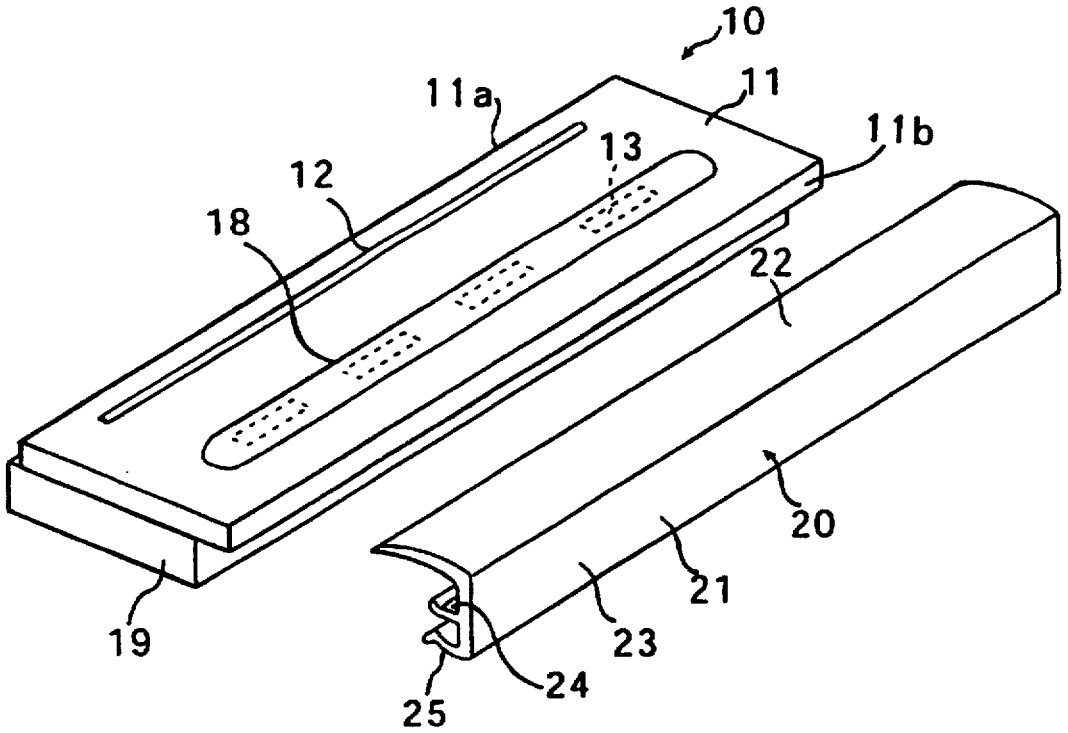
FIG. 2 is an exploded perspective view of the same thermal printhead.
Figure 3:
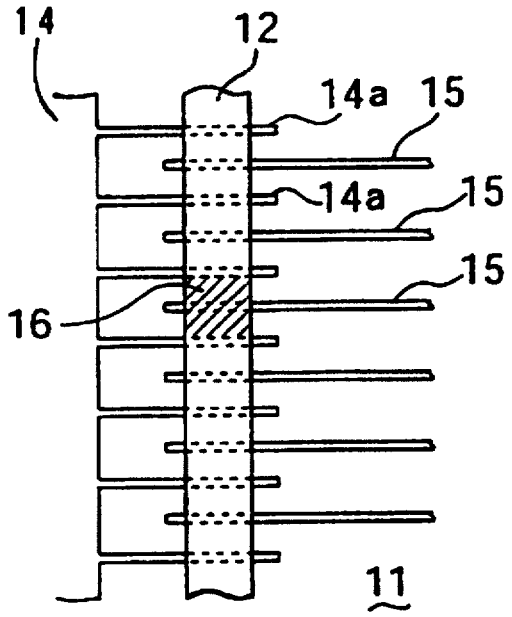
FIG. 3 is an enlarged plan view showing a heating portion of the same thermal printhead.

FIGS. 1–3 show a thermal printhead according to a first embodiment of the present invention.

The thermal printhead according to the first embodiment, which is generally indicated by reference numeral 10, has a basic structure similar to that of a typical thick film-type thermal printhead. Specifically, the thermal printhead 10 includes an elongated rectangular head substrate 11 made of an insulating material such as alumina-ceramic. The upper surface of the head substrate 11 is formed with a heating resistor 12 and drive ICs 13 for actuating the heating resistor 12. The heating resistor 12 is formed into a narrow strip extending along the first edge 11*a* of the head substrate 11 by a thick film printing method using a resistor paste such as ruthenium oxide paste.

The upper surface of the head substrate 10 is formed with a common electrode 14 between the first longitudinal edge 11*a* and the heating resistor 12. As fully shown in FIG. 3, the common electrode 14 has comb-tooth portions 14*a* extending under the heating resistor 12. The upper surface of the head substrate 10 is also formed with a comb-teeth like individual electrodes 15 extending under the heating resistor 12. The respective regions of the heating resistor 12 which are sectionalized by adjacent comb-tooth portions 14*a* of the common electrode 14 function as heating dots 16. When a selected individual electrode 15 is turned on for actuation by a drive IC 13 described hereinafter, a current passes across a corresponding heating dot 16 (the shaded portion shown in FIG. 3, for example) for generation of heat.

The drive ICs 13 are linearly arranged along the second longitudinal edge 11*b* of the head substrate 11. The respective individual electrodes 15 extend toward the second longitudinal edge 11*b* of the head substrate 11 for connection to corresponding output pads (not shown) of the drive ICs 13 via bonding wires 17*a*.

Power pads (not shown) and signal pads (not shown) of the drive ICs 13 are also connected, via bonding wires 17*b*, to a predetermined wiring pattern (not shown) formed on the head substrate 11.

The linearly arranged drive ICs 13 together with the bonding wires 17*a*, 17*b* for electrical connection are enclosed by a hard protection coating 18. The protection coating 18 is made of a thermosetting resin such as an epoxy resin for example. Specifically, the resin in a liquid state is applied to enclose the drive ICs 13 and then cured under heating.

The head substrate 11 is attached to the supporting member 19 via an adhesive for example. At this time, the head substrate 11 is attached to the supporting member 19 so that a predetermined distance L is provided between a longitudinal edge 19*a* of the supporting member 19, which is adjacent to the first longitudinal edge 11*a* of the head substrate 11, and the heating resistor 12. Thus, the heating resistor 12 of the head substrate 11 is positioned with fairly great accuracy relative to the longitudinal edge 19*a* of the supporting member 19. The supporting member 19, which is made of a material having good thermal and electrical conductivities such as aluminum for example, also functions as a heat sink plate.

The drive ICs 13 are covered by the protection coating 18 as well as the protection cover 20. As clearly seen from FIG. 1, the protection cover 20 includes a channel groove-shaped fixation member 21 held in clipping engagement with the other edge 11*b* of the head substrate 11, and a cover member 22 extending from the fixation member 21 to cover the upper sides of the drive ICs 13. The protection cover 20 may be integrally produced by extruding a resin for example.

The channel groove-shaped fixation member 21 of the protection cover 20 includes a pair of vertically spaced projections of clip pieces 24, 25, which are formed integrally with a vertical positioning wall 23 coming into direct contact with the second longitudinal edge 11*b* of the head substrate 11. The upper clip piece 24 has a flat contact surface 24*a* held in close contact with the upper surface of the head substrate 11, while the lower clip piece 25 has an upwardly convex curved portion 25*a*. The distance $L_1$ between the contact surface 24*a* of the upper clip piece 24 and the convex curved portion 25*a* of the lower clip piece 25 is set to be smaller than the thickness $L_2$ of the second longitudinal edge 11*b* of the head substrate 11. The tip 24*b* of the upper clip piece 24 and the tip 25*b* of the convex curved portion 25*a* of the lower clip piece 25 are inclined to each other in an opening manner. Due to this, a guiding function is provided in inserting the head substrate 11 into the channel groove-shaped fixation member 21.

The cover member 22 extends from the upper end of the positioning wall 23 in a gentle, upwardly convex manner toward the first longitudinal edge 11*a* of the head substrate 11 by a predetermined length (long enough to completely cover the drive ICs 13). In the illustrated embodiment, the cover member 22 of the protection cover 20 extends over the protection coating 18 enclosing the drive ICs 13 so that a clearance is provided above the protection coating. Therefore, instead of adopting a hard material such as an epoxy resin described above, a soft material such as silicon resin may be usable for the protection coating 18.

On the other hand, the protection cover 20 is preferably formed by a suitable resin such as polypropylene or ABS resin containing 5–20% of carbon, so that a resistance of about 8–12MΩ is provided. In such an instance, the protection cover 20 is electrostatically conductive.

As shown in FIGS. 1 and 2, the attachment of the protection cover 20 is performed by bringing the channel groove-shaped fixation member 21 into clipping engagement with the second longitudinal edge 11*b* of the head substrate 11. At this time, the clipping operation can be easily performed, since the second longitudinal edge 11*b* of the head substrate 11 is guided by the flaringly inclining tips 24*b*, 25*b* of the respective clip pieces 24, 25 constituting the fixation member 21. In the assembled condition, it is preferable to bring the lower clip piece 25 of the channel groove-shaped fixation member 21 into contact with the supporting member 19.

The minimum distance L between the two clip pieces 24, 25 in the original state is smaller than the thickness $L_2$ of the head substrate 11. Thus, in the assembled state, the two clip pieces 24, 25 are held in clipping engagement with the second longitudinal edge 11*b* of the head substrate 11 with a proper elastic clipping force. Therefore, the protection cover 20 can be attached to the head substrate 11 with a sufficient holding force without using other fixing means such as screws or an adhesive. As a result, the assembling operation is facilitated remarkably, and adaptation to automatic assembling is easily realized.

Figure 4:
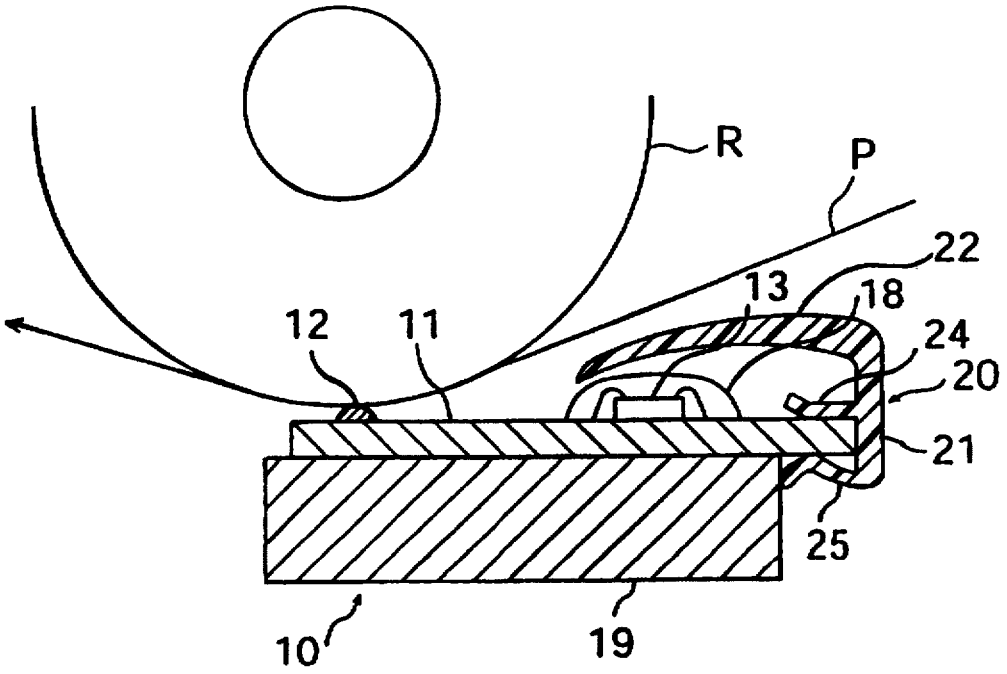
FIG. 4 illustrates the same thermal printhead in operation.

Since the channel groove-shaped fixation member 21 is directly brought into clipping engagement with the second longitudinal edge 11*b* of the head substrate 11, as shown in FIG. 4, the positioning of the protection cover 20 relative to the head substrate 11 is performed with great accuracy. In particular, the cover member 22 can be positioned with great accuracy relative to the heating resistor 12.

As shown in FIG. 4, the transferring path of the recording paper P in a printing unit utilizing the thermal printhead 10 is basically determined by a platen roller R arranged in facing relation to the heating resistor 12 on the head substrate 11. The position of the platen roller R is determined based on that of the heating resistor 12 on the head substrate 11. In the illustrated embodiment, the cover member 22 of the protection cover 20 is positioned based on the head substrate 11, as described above. Therefore, it is possible to arrange the cover member 22 at an intended position with great accuracy relative to the transferring path of the recording paper P. As a result, while uneven contact of the recording paper P with the protection cover 20 is minimized, the projection amount of the cover member 22 is maximized, thereby maximizing the protecting function for the drive ICs 13 and the guiding function for the recording paper P.

In the above embodiment, the protection cover 20, which is made of a carbon-containing synthetic resin, has an electrical conductivity of a predetermined resistance, and the head substrate 11 is mounted on the electrically conductive supporting member 19 having a high thermal conductivity. Further, the lower clip piece 25 of the fixation member 21 of the protection cover 20 is brought into contact with the supporting member 19. Therefore, the static electricity generated on the recording paper P during e.g. high-speed printing is advantageously conducted to the conductive supporting member 19 via the protection cover 20. Thus, the protection cover 20 is prevented from unduly causing electrical short due to accumulated static electricity.

Figure 5:
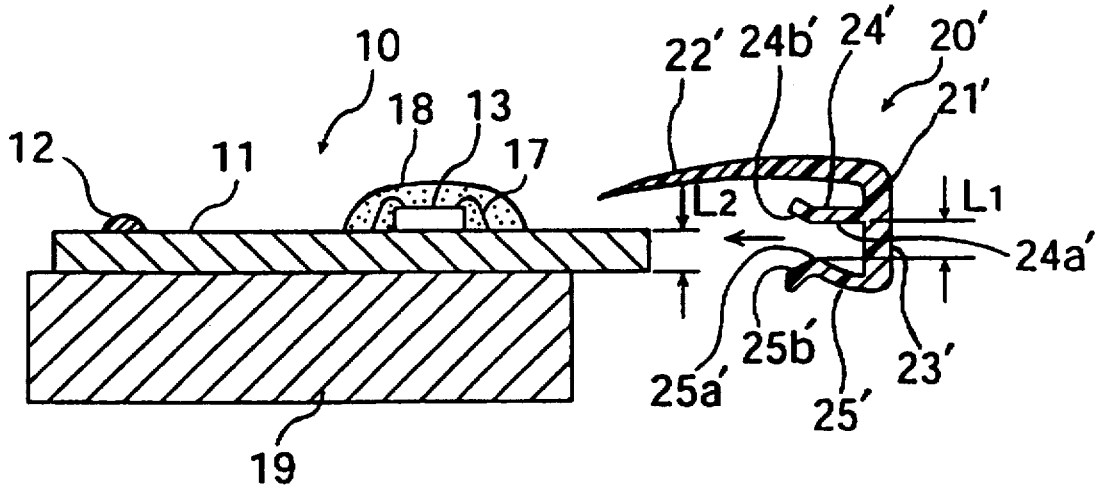
FIG. 5 is a cross-sectional view showing a thermal printhead according to a second embodiment of the present invention.
Figure 6:
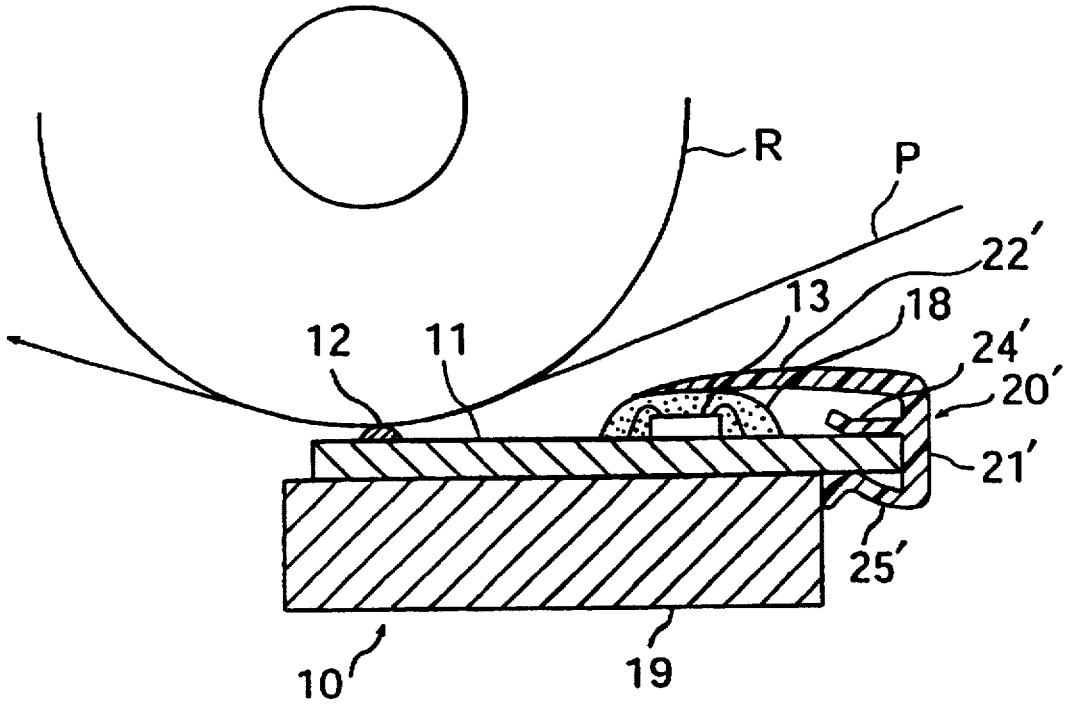
FIG. 6 illustrates the thermal printhead shown in FIG. 5 in operation.

FIGS. 5 and 6 show a thermal printhead according to a second embodiment of the present invention. All the constituting elements except a protection cover of the illustrated embodiment are identical to those of the first embodiment. Therefore the elements are designated by the same reference numerals and a detailed description is not given. Regarding the designation of the constituting elements of the protection cover, a prime (') is added to the reference numerals used for the first embodiment.

Similarly to the first embodiment, the protection cover 20' of the second embodiment includes a fixation member 21' having a positioning wall 23' and a pair of clip pieces 24', 25', and a cover member 22' formed integrally with the fixation member. However, in the second embodiment, the cover member 22' of the protection cover 20' when mounted on the head substrate 11 is elastically urged to be always held in close contact with the surface of the protection coating 18 enclosing the drive ICs 13. To this end, while it is necessary to arrange the cover member 22' of the protection cover 20' to be elastically deformable, the height of the cover member 22' in an original state need be set smaller than the height of the protection coating 18 enclosing the drive ICs 13. As already described, proper elasticity is advantageously given to the cover member 22' by making the protection cover 20' of a carbon-containing synthetic resin. In order to prevent the cover member 23' of the protection cover 20' from unfavorably affecting the drive ICs 13 due to the elastic deformation, the protection coating 18 should be formed by a hard resin.

With the arrangement of the second embodiment, the cover member 22' of the protection cover 20' is elastically held in close contact with the protection coating 18. Thus, it is possible to effectively avoid a transfer error of the recording paper P, which might be otherwise caused when the leading edge of the recording paper P enters a clearance between the cover member 22' and the protection coating 18.

Figure 7:
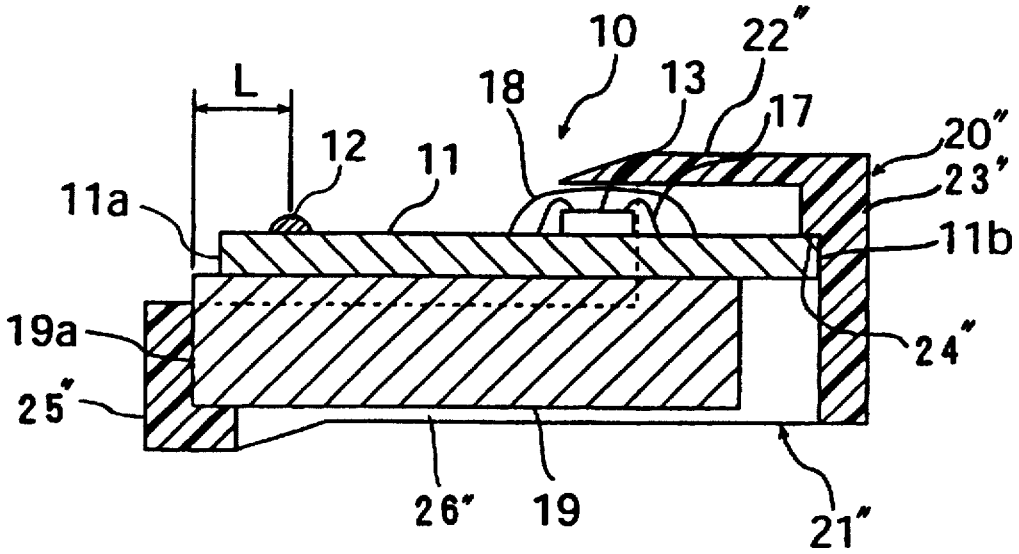
FIG. 7 is a cross-sectional view showing a thermal printhead according to a third embodiment of the present invention.
Figure 9:
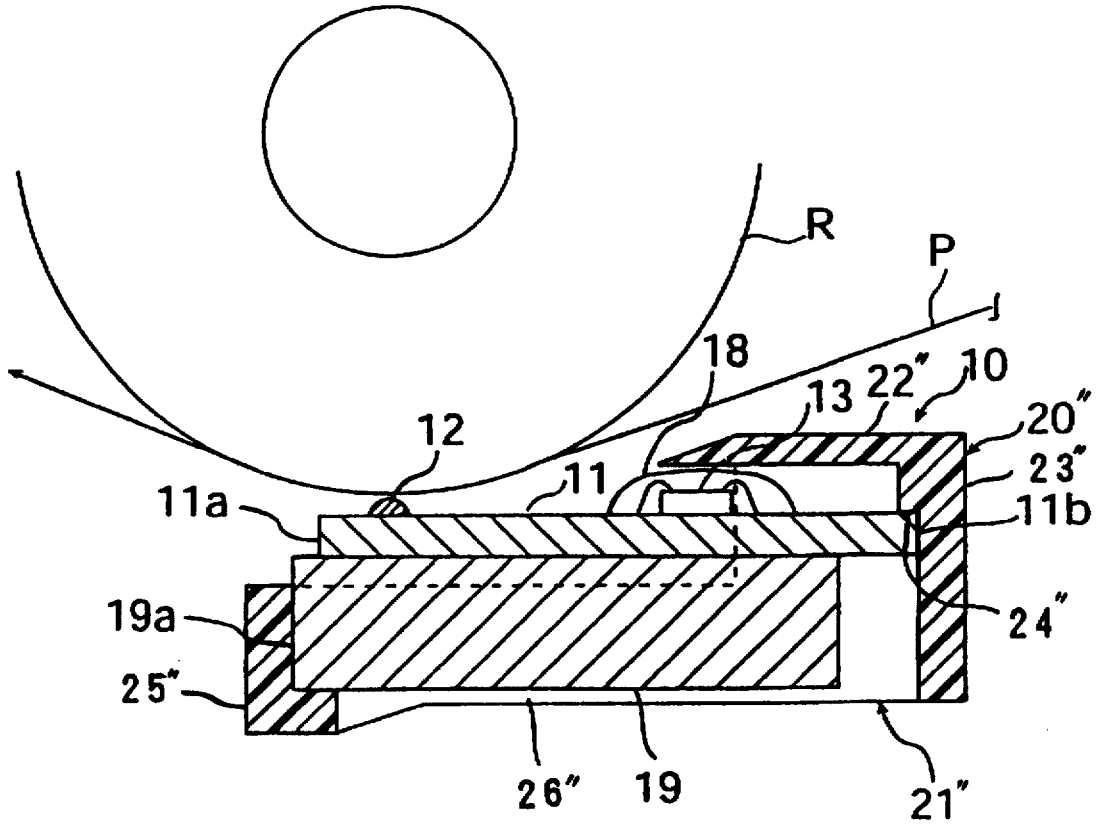
FIG. 9 illustrates the thermal printhead shown in FIG. 7 in operation.
Figure 8:
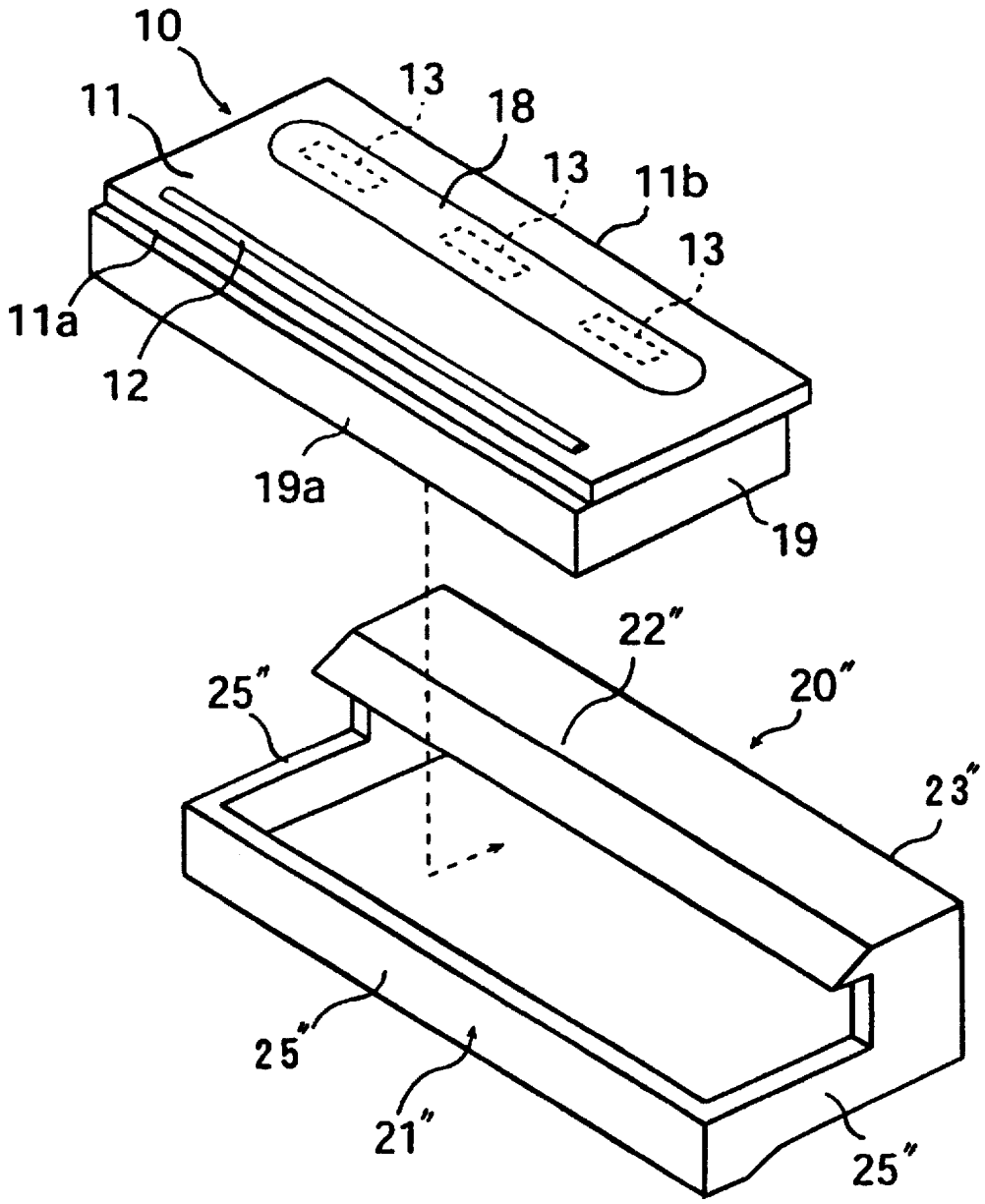
FIG. 8 is an exploded perspective view of the same thermal printhead.

FIGS. 7–9 show a thermal printhead according to a third embodiment of the present invention. The constituting elements except a protection cover of the illustrated embodiment are identical to those of the first embodiment. Therefore, the same reference numerals are used and a detailed description is not given.

The protection cover 20" of the third embodiment includes a fixation member 21" for fitting engagement to the circumference of a thermal printhead 10 constituted by a supporting member 19 and a head substrate 11 carried thereby, and a cover member 22" extending above the drive ICs 13. More specifically, the fixation member 21 is made in the form of an elongated rectangular frame, which includes a positioning wall 23" held in direct contact with the entire length of the second longitudinal edge **11*b* of the head substrate 11, a front engagement wall 25" held in direct contact with the entire length of the longitudinal edge 19*a* of the supporting member 19, and a pair of side walls 26" connecting corresponding ends of the front engagement wall 25" and the positioning wall 23". The positioning wall 23" is provided with a step portion 24" coming into engagement with the upper surface of the head substrate 11 along the second longitudinal edge 11*b* of the head substrate 11. The cover member 22" extends forward from the upper end of the positioning wall 23"**.

Similarly to the first embodiment, it is preferable that the protection cover 20" is integrally formed by a suitable resin such as polypropylene or ABS resin containing 5–20% of carbon, so that the cover has a resistance of about 8–12MΩ for example.

The fixation of the protection cover 20" having the above arrangement is provided by fitting the entirety of the thermal printhead 10 into the frame-shaped fixation member 21", as shown in FIG. 7. In the assembled state of the protection cover 20", the front engagement wall 25" of the fixation member 21" is brought into engagement with the edge **19*a* of the supporting member 19. The heating resistor 12 on the head substrate 11 is positioned based on the edge 19*a*. Thus, the cover member 22" formed integrally with the fixation member 21" can be accurately positioned relative to the edge 19*a* of the supporting member 19 and to the heating resistor 12 on the head substrate 11. Particularly, the positioning wall 23", to which the cover member 22" is directly connected, comes into engagement with the second longitudinal edge 11*b* of the head substrate 11. As a result, the cover member 22" is accurately positioned relative to the heating resistor 12** and the platen R.

As shown in FIG. 9, the transferring path of the recording paper P in a printing unit utilizing the thermal printhead 10 is determined by a platen R arranged in facing relation to the heating resistor 12 on the head substrate 11. The position of the platen R is determined so that the platen is brought into exact facing relation to the heating resistor 12 on the head substrate 11. In the third embodiment, the cover member 22" of the protection cover 20" is disposed at a relatively accurate position relative to the heating resistor 12 on the head substrate 11. Therefore, the cover member 22" is also disposed at a relatively accurate position relative to the platen R in the printing unit. Since the cover member 22" of the protection cover 20" is accurately positioned, the projection amount of the cover member 22" can be rendered as large as possible. Thus, a sufficient amount of overhanging is ensured for the mounting regions of the drive ICs 13, thereby optimizing the protecting function by the protection cover 20 for the drive ICs 13. Further, the attaching operation is remarkably facilitated, since the protection cover 20" is easily attached by fitting the frame-shaped fixation member 21" around the thermal printhead.

The protection cover 20", when made by a carbon-containing synthetic resin, is given electrical conductivity of a proper resistance. In such an instance, since the fixation member 21" of the protection cover 20" is always fitted around the conductive supporting member 19, the static electricity generated at the recording paper is properly conducted to the supporting member 19 via the protection cover 20". As a result, the drive ICs 13 on the head substrate 11 are advantageously prevented from being broken or damaged due to the static electricity, while the protection cover 20" is prevented from unduly causing electrical short.

Figure 10:
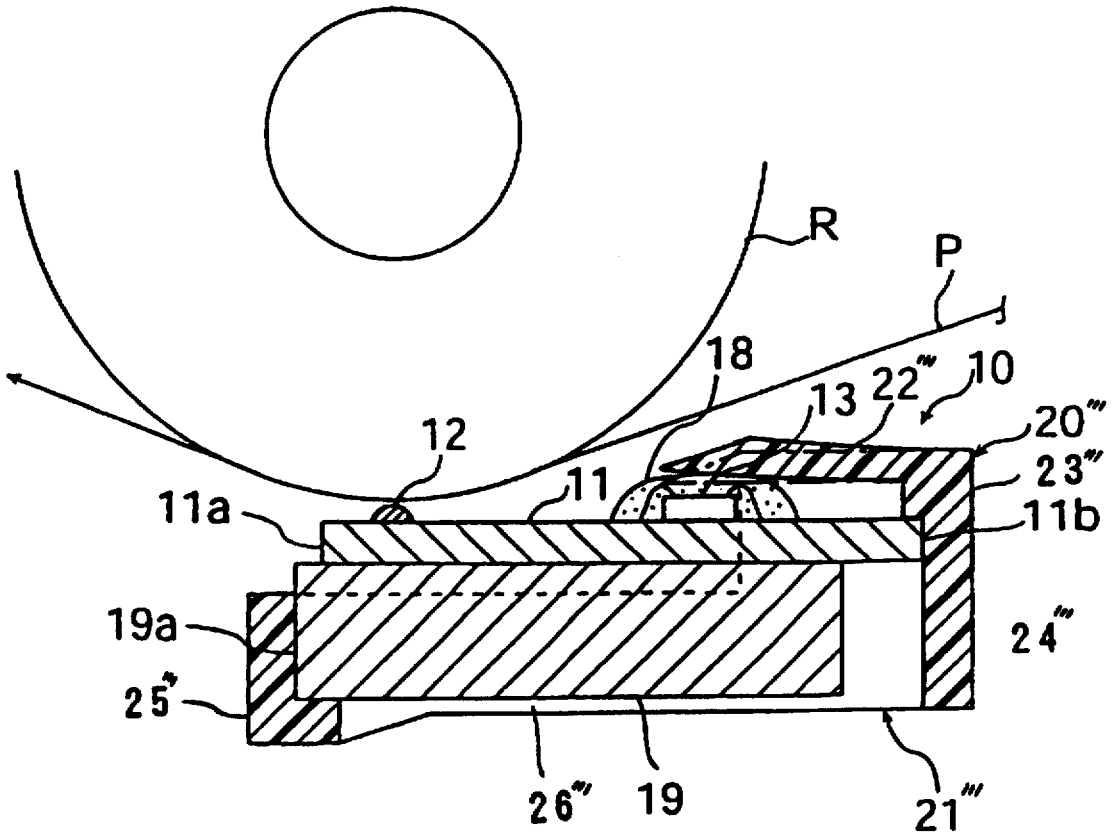
FIG. 10 is a cross-sectional view showing a thermal printhead according to a fourth embodiment of the present invention.

FIG. 10 shows an arrangement of a thermal printhead according to a fourth embodiment of the present invention. Regarding the constituting elements of the illustrated embodiment except a protection cover, they are identical to those of the first embodiment. Thus, the same reference numerals are used, and a detailed description is not given for them.

Similarly to the third embodiment, the protection cover 20''' of the fourth embodiment includes a frame-shaped fixation member 21''' which has a positioning wall 23''' formed with a step portion 24''', a front engagement wall 25''' and a pair of side walls 26''', and a cover member 22''' formed integrally with the fixation member. However, in the fourth embodiment, the cover member 22''' of the protection cover 20''', when mounted on the head substrate 11, is always elastically urged into close contact with the surface of the protection coating 18 enclosing the drive ICs 13. To this end, the cover member 22''' of the protection cover 20''' need be rendered elastically deformable, while the height of the cover member 22''' in an original state should be smaller than the height of the protection coating 18 enclosing the drive ICs 13. As already described, the cover member 22''', when made of a carbon-containing synthetic resin, is advantageously given suitable elasticity. The protection coating 18 should be made of a hard resin to prevent the drive ICs 13 from being unfavorably affected due to the elastic deformation of the cover member 22''' of the protection cover 20'''.

In the fourth embodiment, the cover member 22''' of the protection cover 20''' is elastically urged into close contact with the protection coating 18. Thus, similarly to the second embodiment, a transferring error is effectively eliminated by preventing the leading edge of the recording paper P from entering an otherwise present clearance between the cover member 22''' and the protection coating 18.

It is apparent that the scope of the present invention is not limited to the embodiments described above. For instance, the heating resistor of a thermal printhead may be of a thin film-type other than a thick film-type described above. Further, any protection cover is usable, as far as the positioning relative to the head substrate 11 is performed by the direct contact with the second longitudinal edge **11*b* of the head substrate 11**.

I claim:

1. A thermal printhead comprising:

an insulating head substrate having a first edge and a second edge opposite to the first edge;

a heating resistor formed on the head substrate along the first edge;

at least one drive IC mounted on the head substrate along the second edge; and a protection cover mounted for covering the drive IC;

wherein the protection cover includes a cover member for covering the drive IC and a fixation member formed integrally with the cover member, the fixation member having a positioning wall coming into direct contact with the second edge of the head substrate;

wherein the fixation member of the protection cover comprises a channel groove having a pair of elastically deformable clip pieces projecting from the positioning wall toward the head substrate, a minimum distance between the clip pieces in an original state being smaller than a thickness of the head substrate so that the second edge of the head substrate is clipped by the clip pieces; and wherein one of the clip pieces has a flat contact surface held in surface contact with an obverse surface of the head substrate, the other clip pieces having a convexly curved portion held in contact with a reverse surface of the head substrate.

2. The thermal printhead according to claim 1, further comprising an electrically conductive supporting member having a high thermal conductivity, the head substrate being mounted on the electrically conductive supporting member, the protection cover being electrostatically conductive, a portion of the fixation member of the protection cover contacting the supporting member.

3. The thermal printhead according to claim 2, wherein the protection cover is integrally formed by a carbon-containing synthetic resin.

4. The thermal printhead according to claim 1, wherein the drive IC on the head substrate is enclosed by a hard protection coating the cover member of the protection cover being elastically deformable and held elastically in contact with the protection coating.

5. A thermal printhead comprising:

an electrically conductive supporting member having a high thermal conductivity;

an insulating head substrate mounted on the electrically conductive supporting member, the head substrate having a first edge and a second edge opposite to the first edge;

a heating resistor formed on the head substrate along the first edge;

at least one drive IC mounted on the head substrate along the second edge; and a protection cover mounted for covering the drive IC;

wherein the protection cover includes a cover member for covering the drive IC and a fixation member formed integrally with the cover member, the fixation member having a positioning wall coming into direct contact with the second edge of the head substrate; and wherein the fixation member of the protection cover comprises a frame which includes an engaging front wall coming into engagement with an edge of the supporting member adjacent to the heating resistor, and a pair of side walls connecting the engaging front wall to the positioning wall.

6. The thermal printhead according to claim 5, wherein the positioning wall includes a step portion engaging the obverse surface of the head substrate adjacent the second edge of the head substrate.

7. The thermal printhead according to claim 5, wherein the protection cover is electrostatically conductive.

8. The thermal printhead according to claim 7, wherein the protection cover is integrally formed by a carbon-containing synthetic resin.

9. A protection cover mounted on a thermal printhead including an insulating head substrate having a first edge and a second edge opposite to the first edge, a heating resistor formed on the head substrate along the first edge, and at least one drive IC mounted on the head substrate along the second edge, the protection cover comprising:

a cover member for covering the drive IC, and a fixation member formed integrally with the cover member, the fixation member having a positioning wall coming into direct contact with the second edge of the head substrate;

wherein the fixation member of the protection cover comprises a channel groove having a pair of elastically deformable clip pieces projecting from the positioning wall in a same direction as the cover member, a minimum distance between the clip pieces in an original state being smaller than a thickness of the head substrate so that the second edge of the head substrate is clipped by the clip pieces; and wherein one of the clip pieces has a flat contact surface held in surface contact with an obverse surface of the head substrate, the other clip piece having a convexly curved portion held in contact with a reverse surface of the head substrate.

10. The protection cover according to claim 9, wherein the cover is integrally formed by a carbon-containing synthetic resin.

11. The protection cover according to claim 9, wherein the cover member is elastically deformable.

12. A protection cover mounted on a thermal printhead which includes: an electrically conductive supporting member having a high thermal conductivity; an insulating head substrate mounted on the electrically conductive supporting member, the head substrate having a first edge and a second edge opposite to the first edge; a heating resistor formed on the head substrate along the first edge; and at least one drive IC mounted on the head substrate along the second edge; the protection cover comprising:

a cover member for covering the drive IC, and a fixation member formed integrally with the cover member, the fixation member having a positioning wall coming into direct contact with the second edge of the head substrate;

wherein the fixation member of the protection cover comprises a frame which includes an engaging front wall coming into engagement with an edge of the supporting member adjacent to the heating resistor, and a pair of side walls connecting the engaging front wall to the positioning wall.

13. The protection cover according to claim 12, wherein the positioning wall includes a step portion which engages the obverse surface of the head substrate adjacent the second edge of the head substrate.

* * * * *